US007358677B2

(12) United States Patent
Gielen

(10) Patent No.: US 7,358,677 B2
(45) Date of Patent: Apr. 15, 2008

(54) LOW-PRESSURE MERCURY VAPOR DISCHARGE LAMP HAVING DETERMINED PROBABILITY OF FAILURE

(75) Inventor: Herman Johannes Gertrudis Gielen, Roosendaal (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 79 days.

(21) Appl. No.: 10/566,964

(22) PCT Filed: Jul. 20, 2004

(86) PCT No.: PCT/IB2004/051262

§ 371 (c)(1),
(2), (4) Date: Jan. 26, 2006

(87) PCT Pub. No.: WO2005/010922

PCT Pub. Date: Feb. 3, 2005

(65) Prior Publication Data

US 2006/0214591 A1 Sep. 28, 2006

(30) Foreign Application Priority Data

Jul. 29, 2003 (EP) ..... 03102327

(51) Int. Cl.
*H01Q 1/26* (2006.01)
*H01J 17/04* (2006.01)
*H01J 17/20* (2006.01)

(52) U.S. Cl. ..... 315/34; 315/51; 313/631; 313/642

(58) Field of Classification Search ..... 315/32, 315/34, 49, 51, 56; 313/621, 631, 639, 642, 313/643, 637, 633
See application file for complete search history.

(56) References Cited

U.S. PATENT DOCUMENTS

| | | | | |
|---|---|---|---|---|
| 2,530,394 | A * | 11/1950 | Lowry et al. | 313/491 |
| 3,215,892 | A | 11/1965 | Waymouth | |
| 3,740,609 | A * | 6/1973 | Moerkens | 315/200 R |
| 5,449,971 | A * | 9/1995 | Scott et al. | 313/631 |
| 6,809,477 | B2 * | 10/2004 | Soules et al. | 313/631 |

FOREIGN PATENT DOCUMENTS

| | | | |
|---|---|---|---|
| GB | 1172723 | A | 12/1969 |
| JP | 04061740 | A | 2/1992 |
| JP | 05089982 | A | 4/1993 |
| JP | 09147807 | A | 6/1997 |
| JP | 2000285863 | A | 10/2000 |

* cited by examiner

*Primary Examiner*—Thuy Vinh Tran

(57) ABSTRACT

Low-pressure mercury vapor discharge lamp has a discharge vessel (10) enclosing, in a gastight manner, a discharge space (13) provided with a filling of mercury and an inert gas in a gastight manner. The discharge vessel comprising electrodes (20*a*; 20*b*) arranged in the discharge space for maintaining a discharge in the discharge space. According to the invention, the probability of failure of the low-pressure mercury vapor discharge lamp being substantially determined by one of the electrodes. As upon igniting the low-pressure mercury vapor discharge lamp the ignition-related events influence the electrodes, preferably, the ignition-related events substantially are prevented affecting the one electrode.

11 Claims, 3 Drawing Sheets

LOW-PRESSURE MERCURY VAPOR DISCHARGE LAMP HAVING DETERMINED PROBABILITY OF FAILURE

This application is a National Phase Application under 35 U.S.C. 371 claiming the benefit of PCT/IB04/51262 filed on Jul. 20, 2004, which has priority based on European Patent office (EPO) Application No. 03102327.8 filed on Jul. 29, 2003.

The invention relates to a low-pressure mercury vapor discharge lamp.

In mercury vapor discharge lamps, mercury constitutes the primary component for the (efficient) generation of ultraviolet (UV) light. A luminescent layer comprising a luminescent material may be present on an inner wall of the discharge vessel to convert UV to other wavelengths, for example, to UV-B and UV-A for tanning purposes (sun panel lamps) or to visible radiation for general illumination purposes. Such discharge lamps are therefore also referred to as fluorescent lamps. Alternatively, the ultraviolet light generated may be used for manufacturing germicidal lamps (UV-C). The discharge vessel of low-pressure mercury vapor discharge lamps is usually circular and comprises both elongate and compact embodiments. Generally, the tubular discharge vessel of compact fluorescent lamps comprises a collection of relatively short straight parts having a relatively small diameter, which straight parts are connected together by means of bridge parts or via bent parts. Compact fluorescent lamps are usually provided with an (integrated) lamp cap. Normally, the means for maintaining a discharge in the discharge space are electrodes arranged in the discharge space. In an alternative embodiment the low-pressure mercury vapor discharge lamp comprises a so-called electrodeless low-pressure mercury vapor discharge lamp.

Low-pressure mercury vapor discharge lamps as mentioned in the opening paragraph are well known in the art. A disadvantage of the known low-pressure mercury vapor discharge lamp is that the spread in lifetime of the discharge lamp is relatively large. This implies that when a large number of discharge lamps is installed, e.g., in a building, the spread in lifetime of the discharge lamps makes a so-called group exchange of the discharge lamps unfavorable.

The invention has for its object to eliminate the above disadvantage wholly or partly. According to the invention, a low-pressure mercury vapor discharge lamp of the kind mentioned in the opening paragraph for this purpose comprises:

a discharge vessel enclosing, in a gastight manner, a discharge space provided with a filling of mercury and an inert gas in a gastight manner, the discharge vessel comprising electrodes arranged in the discharge space for maintaining a discharge in the discharge space, the probability of failure of the low-pressure mercury vapor discharge lamp being substantially determined by one of the electrodes.

By confining the probability of failure of the low-pressure mercury vapor discharge lamps to one of the electrodes, efforts in reducing the spread in lifetime can be focused on that one electrode. A good control of the one electrode leads to an improved control of the lamp life and to an improved control of the spread in lamp life of the low-pressure mercury vapor discharge lamp according to the invention. The probability of failure of the low-pressure mercury vapor discharge lamp according to the invention can be influenced by carefully controlling the ignition behavior of the one electrode and/or by carefully controlling the construction and surroundings of the one electrode.

The spread in lifetime of the low-pressure mercury vapor discharge lamps according to the invention is considerably reduced. According to the measure of the invention, the spread in the lifetime of low-pressure mercury vapor discharge lamps is considerably reduced enabling a group replacement of all low-pressure mercury vapor discharge lamp. Such an integral replacement of all discharge lamps is more favorable than replacing individual discharge lamps every time a discharge lamp extinguishes.

One aspect relating to the probability of failure of the electrodes in low-pressure mercury vapor discharge lamps is related to the ignition behavior of the discharge lamp. Ignition of a low-pressure mercury vapor discharge lamp gives rise to so-called ignition-related damage on the electrodes. As a rule of thumb, it is normally assumed that igniting a low-pressure mercury vapor discharge lamp once is equivalent to typically 0.5-8 hours burning the discharge lamp. The value depends on the ballast used. A consequence of this rule of thumb is that the more frequent a discharge lamp is ignited the earlier the electrodes will reach a situation in which the discharge lamp can no longer ignited because the emitter material on the electrodes is consumed. To this end, a preferred embodiment of the low-pressure mercury vapor discharge lamp is characterized in that upon igniting the low-pressure mercury vapor discharge lamp, ignition-related events influence the electrodes, the ignition-related events being substantially prevented from affecting the one electrode. By keeping away the ignition-related events from the one electrode, this electrode is not influenced by the ignition-related events and the probability of failure of the one electrode is substantially entirely determined by the burning hours of the low-pressure mercury vapor discharge lamp.

In this manner, the life of the low-pressure mercury vapor discharge lamp according to the invention depends on the frequency of switching the discharge lamp. In addition, a consequence of the switching life being dependent on the ballast is that the life of the low-pressure mercury vapor discharge lamp according to the invention is no longer dependent on the ballast. According to the invention a low-pressure mercury vapor discharge lamp can be manufactured with a lamp life that is independent of the switching cycle and has a reduced dependence of the switching cycle at which the discharge lamps are operated and are also independent of show a reduced dependence of the type of ballast used.

A preferred embodiment of the low-pressure mercury vapor discharge lamp according to the invention is characterized in that the low-pressure mercury vapor discharge lamp, upon igniting, is substantially operated under DC current conditions and, during further operation, is substantially operated under AC current conditions. By igniting the low-pressure mercury vapor discharge lamp under DC current conditions, the polarity of the current can be selected in such a manner that the ignition of the low-pressure mercury vapor discharge lamp does not take place at the one electrode. In this manner, the ignition-related events are kept away from the one electrode, thereby avoiding that this electrode is influenced by the ignition-related events. In this manner, the probability of failure of the one electrode is substantially entirely determined only by the burning hours of the low-pressure mercury vapor discharge lamp and not by the number of switches. The life of the low-pressure mercury vapor discharge lamp according to the invention is determined by the one electrode.

Another way of keeping away the ignition-related events from the one electrode is using a ballast means having a preference for keeping away the ignition-related events from the one electrode. To this end, a preferred embodiment of the low-pressure mercury vapor discharge lamp according to the invention is characterized in that the low-pressure mercury vapor discharge lamp is operated on a ballast circuit, the ballast circuit comprising means for substantially keeping the ignition away from the one electrode. Preferably, the ballast comprises a circuit assembly comprising a diode. A diode in a ballast circuit is an effective means for keeping away the ignition-related events from the one electrode. In an embodiment, the diode is comprised in the glow starter circuit.

A preferred embodiment of the low-pressure mercury vapor discharge lamp according to the invention is characterized in that the low-pressure mercury vapor discharge lamp comprises a glow starter circuit comprising a circuit assembly comprising a diode. Preferably, the glow starter circuit is operated on a single-side pulse. This can be realized by an electronic starter circuit assembly or by modifying the construction of the electrode in the glow starter circuit.

Another aspect relating to the probability of failure of the electrodes in low-pressure mercury vapor discharge lamps is related to constructional aspects of the one electrode. In addition, aspects of how the one electrode is arranged in the discharge vessel are considered.

A preferred embodiment of the low-pressure mercury vapor discharge lamp according to the invention is characterized in that the electrodes are provided with an emitter material for supplying electrons to the discharge, the mass of the emitter material of the one electrode being 20% lower than the average mass of the emitter material of the electrodes. By reducing the mass of the emitter material of the one electrode as compared to the other electrode, the probability of failure of the low-pressure mercury vapor discharge lamp is substantially determined by the consumption of the emitter material of the one electrode.

An alternative preferred embodiment of the low-pressure mercury vapor discharge lamp according to the invention is characterized in that the electrodes are provided with an emitter material for supplying electrons to the discharge, the content of barium, calcium and/or strontium in the emitter material of the one electrode being 20% lower than the average barium, calcium or strontium content in the emitter material of the electrodes, respectively. By selectively changing the content of barium, calcium and/or strontium in the emitter material of the one electrode as compared to the other electrode, the probability of failure of the low-pressure mercury vapor discharge lamp is substantially determined by composition of the emitter material of the one electrode.

A further alternative preferred embodiment of the low-pressure mercury vapor discharge lamp according to the invention is characterized in that the temperature of the one electrode is 20% lower than the average temperature of the electrodes. The temperature difference between the electrodes can be expressed in the resistance of the hot electrode as compared to the resistance of the cold electrode.

A preferred embodiment of the low-pressure mercury vapor discharge lamp according to the invention is characterized in that the one electrode is surrounded by an electrode ring, the electrode ring functioning as a cage of Faraday. In an alternative embodiment the electrode is surrounded by a conducting layer provided on a glass substrate. In this manner, the ignition-related events are substantially kept away from the one electrode.

An alternative preferred embodiment of the low-pressure mercury vapor discharge lamp according to the invention is characterized in that an antenna is provided in the vicinity of the one electrode for guiding away the discharge upon igniting the low-pressure mercury vapor discharge lamp. The antenna functions as a means for catching and absorbing any discharges during igniting of the low-pressure mercury vapor discharge lamp. In this manner, the ignition-related events are substantially kept away from the one electrode. Preferably, the antenna comprises a bi-metal.

These and other aspects of the invention are apparent from and will be elucidated with reference to the embodiments described hereinafter.

In the drawings.

The Figures are purely diagrammatic and not drawn to scale. Notably, some dimensions are shown in a strongly exaggerated form for the sake of clarity. Similar components in the Figures are denoted as much as possible by the same reference numerals.

Figure 1:
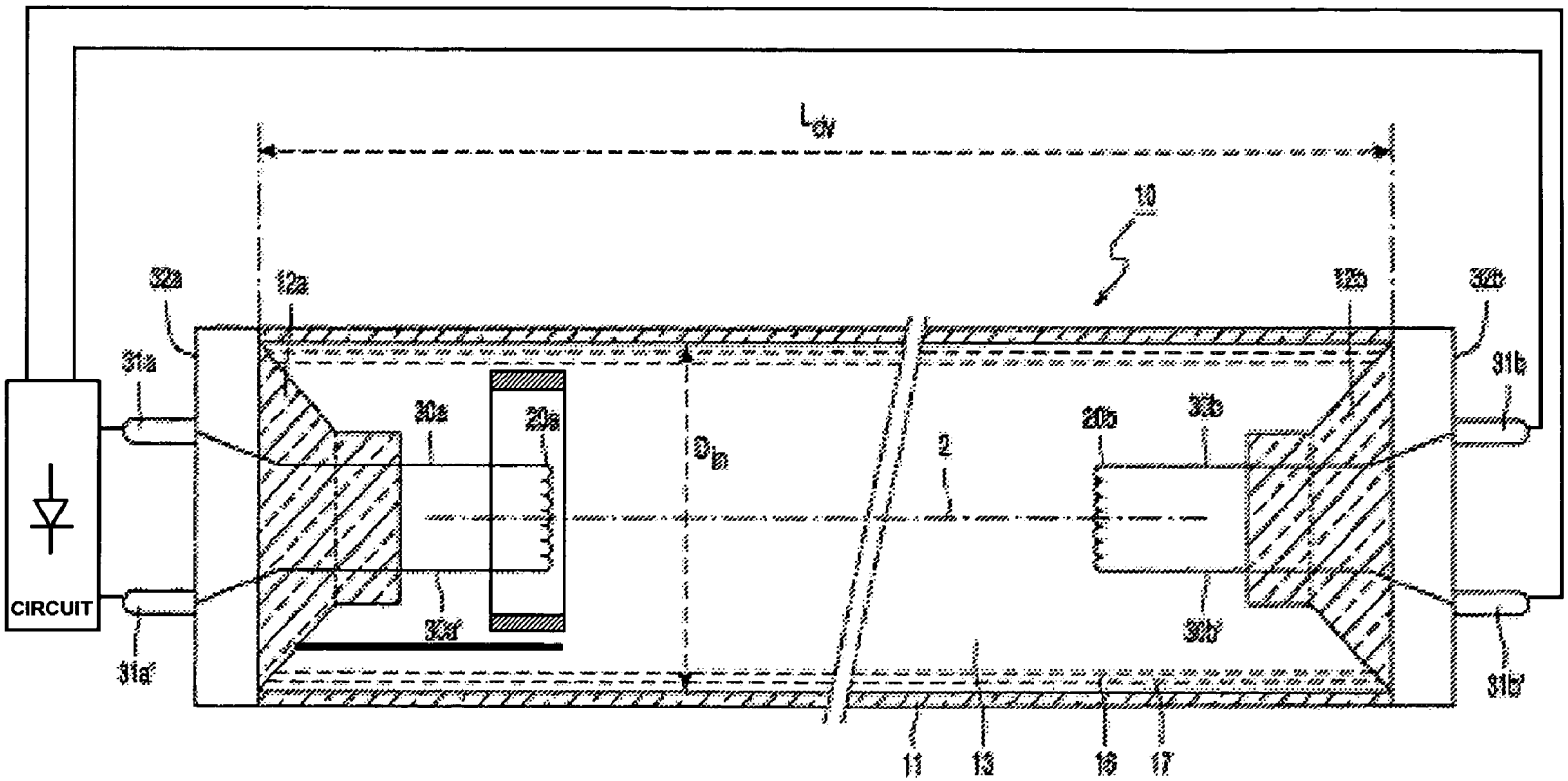
FIG. 1 is a cross-sectional view of a low-pressure mercury-vapor discharge lamp in accordance with the invention.

FIG. 1 very schematically shows a low-pressure mercury-vapor discharge lamp comprising a glass discharge vessel having a tubular portion 11 about a longitudinal axis 2, which discharge vessel transmits radiation generated in the discharge vessel 10 and is provided with a first and a second end portion 12*a*; 12*b*, respectively. In this example, the tubular portion 11 has a length $L_{dv}$ of approximately 120 cm and an inside diameter $D_{in}$ of approximately 14 mm. The discharge vessel 10 encloses, in a gastight manner, a discharge space 13 containing a filling of mercury and an inert gas mixture comprising for example argon. In the example of FIG. 1, the side of the tubular portion 11 facing the discharge space 13 is provided with a protective layer 17. In an alternative embodiment the first and second end portions 12*a*; 12*b* are also coated with a protective layer. In fluorescent discharge lamps, the side of the tubular portion 11 facing the discharge space 13 is, in addition, coated with a luminescent layer 16 including a luminescent material (for example a fluorescent powder) which converts the ultraviolet (UV) light generated by fallback of the excited mercury into (generally) visible light. In an alternative embodiment the luminescent layer 16, in addition, is provided with a further protective layer (not shown in FIG. 1).

In the example of FIG. 1 means for maintaining a discharge in the discharge space 13 are electrodes 20*a*; 20*b* arranged in the discharge space 13, said electrodes 20*a*; 20*b* being supported by the end portions 12*a*; 12*b*. The electrode 20*a*; 20*b* is a winding of tungsten covered with an electron-emitting substance, in this case a mixture of barium oxide, calcium oxide and strontium oxide. Current-supply conductors 30*a*, 30*a*'; 30*b*, 30*b*' of the electrodes 20*a*; 20*b*, respectively, pass through the end portions 12*a*; 12*b* and issue from the discharge vessel 10 to the exterior. The current-supply conductors 30*a*, 30*a*'; 30*b*, 30*b*' are connected to contact pins 31*a*, 31*a*'; 31*b*, 31*b*' secured to a lamp cap 32*a*, 32*b*. In general, around each electrode 20*a*; 20*b* an electrode ring is arranged (not shown in FIG. 1) on which a glass capsule for proportioning mercury is clamped.

According to the invention, the probability of failure of the low-pressure mercury vapor discharge lamp is substantially determined by the one electrode 20*a*. By confining the probability of failure of the low-pressure mercury vapor discharge lamps to the one electrode 20*a*, efforts in reducing the spread in lifetime can be focused on that one electrode. A good control of the one electrode 20*a* leads to an improved control of the lamp life and to an improved control of the spread in lamp life of the low-pressure mercury vapor discharge lamp according to the invention. In a manner of speaking, the one electrode becomes the "weakest link" of the low-pressure mercury vapor discharge lamp.

One aspect relating to the probability of failure of the electrodes in low-pressure mercury vapor discharge lamps is related to the ignition behavior of the discharge lamp. Ignition of a low-pressure mercury vapor discharge lamp gives rise to so-called ignition-related damage on the electrodes. As a rule of thumb, it is normally assumed that igniting a low-pressure mercury vapor discharge lamp once is equivalent to typically 0.5-8 hours burning the discharge lamp. This value depends on the ballast used. For cold igniting discharge lamps, once igniting the discharge lamp is equivalent to 7-10 hours burning the discharge lamp. When the lamp is so-called hot-ignited, once igniting the discharge lamp is equivalent to approximately 0.5 hours burning the discharge lamp. A consequence of this dependence of the ballast is that the life of the low-pressure mercury vapor discharge lamp according to the invention is no longer dependent on the ballast.

Figure 2A:
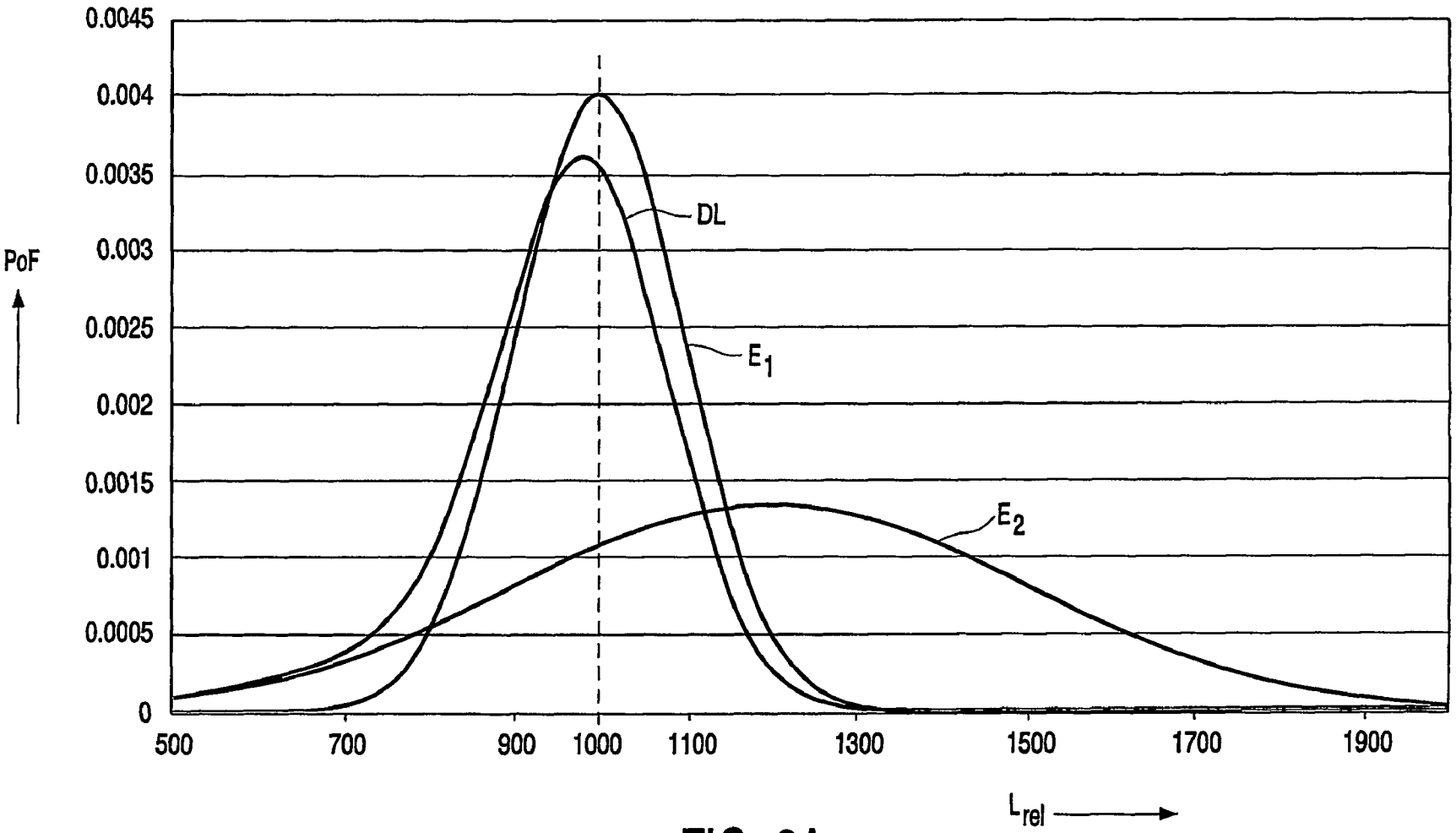
FIG. 2A shows the probability of failure of the low-pressure mercury vapor discharge lamp according to the invention.

FIG. 2A shows the probability of failure (PoF) of the low-pressure mercury vapor discharge lamp as a function of the relative life ($L_{rel}$) of the discharge lamp. Curve referenced $E_1$ gives the probability of failure of the one electrode 20*a*, curve $E_2$ gives the probability of failure of the other electrode 20*b*. These curves are typical so-called Gaussian curves with a maximum around a relative life expressed as 1000 in FIG. 2A and with two tails, one tail exemplifying electrodes which are depleted early (relative life<1000) and the other tail exemplifying electrodes which have a relatively very long life (relative life>1000). The curve for the probability of failure of the low-pressure mercury vapor discharge lamp referenced DL is calculated from E1 and E2. Looking at the curves in FIG. 2A, it can be seen that the probability of failure distribution for the discharge lamp resulting from the two electrodes is neither a normal or symmetric distribution.

Figure 2B:
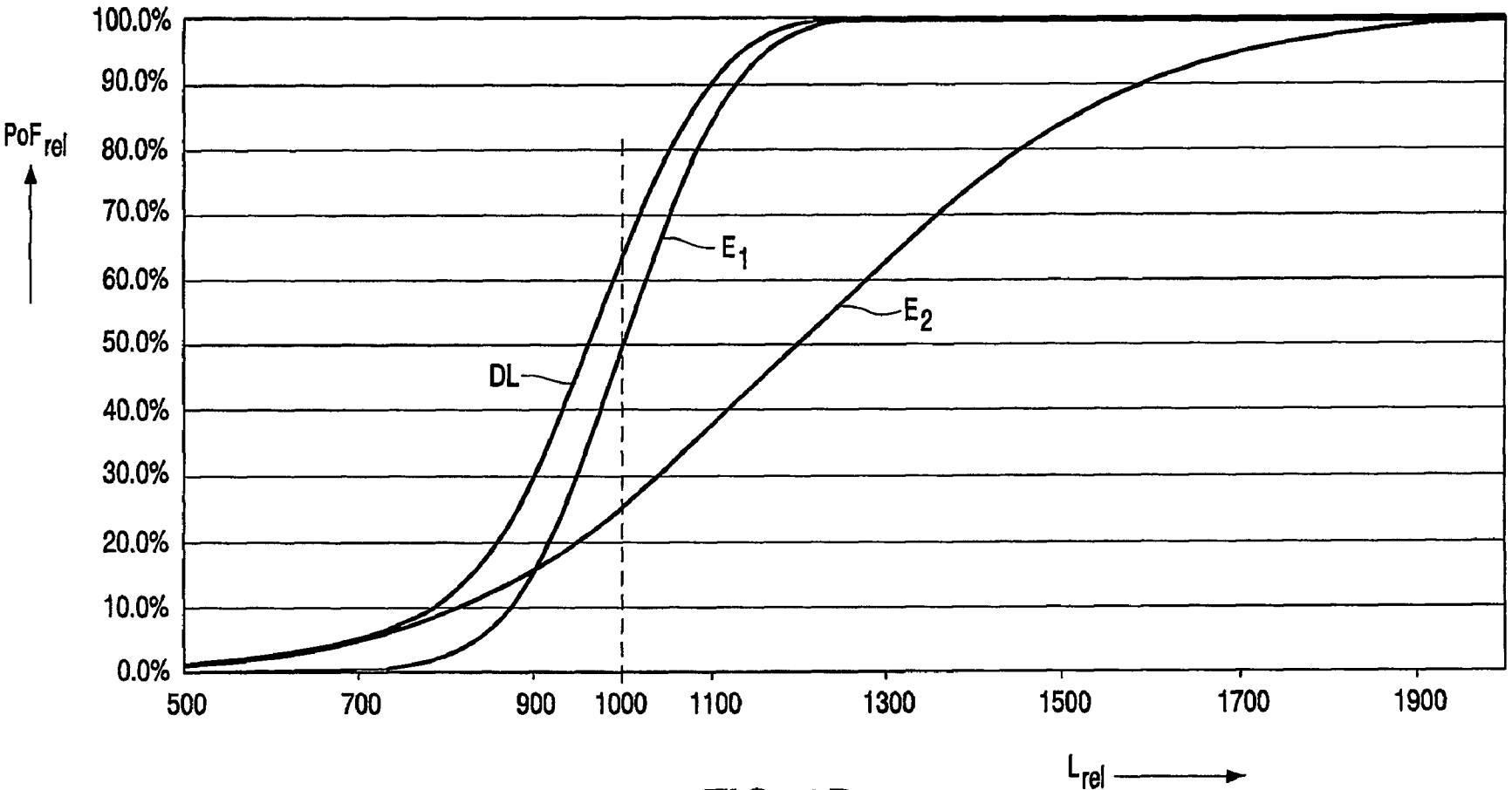
FIG. 2B shows the cumulative probability of failure of the low-pressure mercury vapor discharge lamp as shown in FIG. 2A.

FIG. 2B shows the cumulative probability of failure (PoF) as a function of the relative life ($L_{rel}$) of the low-pressure mercury vapor discharge lamp as shown in FIG. 2A. Curve referenced $E_1$ gives the probability of failure of the one electrode 20*a*, curve $E_2$ gives the probability of failure of the other electrode 20*b*. These curves are typical so-called Gaussian curves with a maximum around a relative life expressed as 1000 in FIG. 2A and with two tails, one tail exemplifying electrodes which are depleted early (relative life<1000) and the other tail exemplifying electrodes which have a relatively very long life (relative life>1000). The curve for the probability of failure of the low-pressure mercury vapor discharge lamp referenced DL is calculated from E1 and E2.

It can be learned from FIGS. 2A and 2B that with increasing shift towards longer median lifetimes of the other electrode 20*b*, the median probability of failure of the low-pressure mercury vapor discharge lamp evolves towards the median probability of failure of the one electrode 20*a*. In other words, by confining the probability of failure of the low-pressure mercury vapor discharge lamps to the one electrode, efforts in reducing the spread in lifetime can be focused on that one electrode. In addition, the width of the distribution of the probability of failure of the discharge lamp substantially evolves towards the width of the curve with the probability of failure of the one electrode. It is noted that due to the normal spread in a manufacturing environment equalizing the median lifetime of the electrode leads to a broadening of the life time distribution.

Note that in all situations the median value of the probability of failure of the discharge lamp is below that of the one electrode; the introduction of an additional failure source, the second electrode, substantially reduces the median probability of failure of the discharge lamp with respect to the median probability of failure of the one electrode only. If the electrodes would be practically the same, the median value as well as the width of the probability of failure curve for the discharge lamp are smaller that that of the individual electrodes.

The probability of failure of the low-pressure mercury vapor discharge lamp according to the invention can influenced by carefully controlling the ignition behavior of the one electrode and/or by carefully controlling the construction and surroundings of the one electrode.

Upon igniting the low-pressure mercury vapor discharge lamp, ignition-related events influence the electrodes. According to a preferred embodiment of the low-pressure mercury vapor discharge lamp, the ignition-related events are substantially prevented from affecting the one electrode. By keeping away the ignition-related events from the one electrode, this electrode is not influenced by the ignition-related events and the probability of failure of the one electrode is substantially entirely determined by the burning hours of the low-pressure mercury vapor discharge lamp. The low-pressure mercury vapor discharge lamp according to the invention is not dependent on the switching cycle and is not dependent on the choice of the ballast circuit assembly. Preferably, the low-pressure mercury vapor discharge lamp, upon igniting, is substantially operated under DC current conditions and, during further operation, is substantially operated under AC current conditions. By igniting the low-pressure mercury vapor discharge lamp under DC current conditions, the polarity of the current can be selected in such a manner that the ignition of the low-pressure mercury vapor discharge lamp does not take place at the one electrode. By keeping away the ignition-related events are kept away from the one electrode, the probability of failure of the one electrode is substantially entirely determined by the burning hours of the low-pressure mercury vapor discharge lamp.

Preferably, the low-pressure mercury vapor discharge lamp is operated on a ballast circuit, the ballast circuit comprising means for substantially keeping the ignition away from the one electrode. Preferably, the ballast comprises a diode. A diode in a ballast circuit is an effective means for keeping away the ignition-related events from the one electrode.

In another preferred embodiment of the low-pressure mercury vapor discharge lamp, the electrodes are provided with an emitter material for supplying electrons to the discharge, the mass of the emitter material of the one electrode being 20% lower than the average mass of the emitter material of the electrodes. By reducing the mass of the emitter material of the one electrode as compared to the other electrode, the probability of failure of the low-pressure mercury vapor discharge lamp is substantially determined by the depletion of the emitter material of the one electrode.

Preferably, the electrodes are provided with an emitter material for supplying electrons to the discharge, the content of barium, calcium and/or strontium in the emitter material of the one electrode being 20% lower than the average barium, calcium or strontium content in the emitter material of the electrodes, respectively. By selectively changing the content of barium, calcium and/or strontium in the emitter material of the one electrode as compared to the other electrode, the probability of failure of the low-pressure mercury vapor discharge lamp is substantially determined by composition of the emitter material of the one electrode.

Preferably, the temperature of the one electrode is 20% lower than the average temperature of the electrodes. The temperature difference between the electrodes can be expressed in the resistance $R_{hot}$ of the hot electrode as compared to the resistance $R_{cold}$ of the cold electrode. Under normal conditions, $R_{hot}/R_{cold}$ is in the range between 4 and 5. When $R_{hot}/R_{cold}<4$, the hot electrode is at a relatively too low temperature giving rise to a high sputtering of the electrode. When $R_{hot}/R_{cold}>5$, the hot electrode is at a relatively too high temperature giving rise to a high evaporation of the emitter material of the electrode.

Preferably, $$(R_{hot}/R_{cold})_{one}/[(R_{hot}/R_{cold})_{one}+(R_{hot}/R_{cold})_{other}]\leqq 0.8$$

Preferably, the one electrode is surrounded by an electrode ring, the electrode ring functioning as a cage of Faraday. A so-called cage of Faraday or Faraday shield surrounding or enclosing the one electrode reduces the effect of electrical fields on the one electrode. In this manner, the ignition-related events are substantially kept away from the one electrode.

Preferably, an antenna is provided near the one electrode for guiding away the discharge upon igniting the low-pressure mercury vapor discharge lamp. The antenna functions as a means for catching and absorbing any discharges during igniting of the low-pressure mercury vapor discharge lamp. In this manner, the ignition-related events are substantially kept away from the one electrode. Preferably, the antenna comprises a bi-metal.

The spread in lifetime of the low-pressure mercury vapor discharge lamps according to the invention is considerably reduced. According to the measure of the invention, it becomes possible to manufacture low-pressure mercury vapor discharge lamp with a median lifetime of approximately 24,000 hours with less than 10% failures after 21,000 hours. Due to this relatively small spread in the probability of failure of the low-pressure mercury vapor discharge lamps according to the invention, a group replacement of all low-pressure mercury vapor discharge lamp becomes (economically) more favorable than replacing individual discharge lamps every time a (single) discharge lamp extinguishes. This is in particular an advantage if the discharge lamps are positioned at places that are difficult to reach.

The low-pressure mercury vapor discharge lamp according to the invention comprises a so-called "weakest link" electrode that substantially experiences burning damage but is shielded from switching damage. This "weakest link" electrode dominates the probability of failure of the low-pressure mercury vapor discharge lamp. In addition, the low-pressure mercury vapor discharge lamp according to the invention comprises a so-called "strongest link" electrode that substantially experiences burning and switching damage but which electrode is not substantially influencing the probability of failure of the low-pressure mercury vapor discharge lamp.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A low-pressure mercury-vapor discharge lamp comprising:

a discharge vessel enclosing, in a gastight manner, a discharge space provided with a filling of mercury and an inert gas in a gastight manner, and electrodes arranged in the discharge space for maintaining a discharge in the discharge space, wherein the probability of failure of the low-pressure mercury vapor discharge lamp being substantially determined by one of the electrodes, further wherein the electrodes are provided with an emitter material for supplying electrons to the discharge, the mass of the emitter material of the one electrode being 20% lower than the average mass of the emitter material of the electrodes.

2. A low-pressure mercury vapor discharge lamp as claimed in claim 1, wherein upon igniting the low-pressure mercury vapor discharge lamp, ignition-related events corresponding to ignition behavior of the discharge lamp can give rise to ignition-related damage on the electrodes, the lamp further comprising:

means for preventing the ignition-related events from affecting the one electrode.

3. A low-pressure mercury vapor discharge lamp as claimed in claim 1, wherein the low-pressure mercury vapor discharge lamp further comprising:

means for controlling the lamp, upon igniting, to be substantially operated under DC current conditions and, during further operation, to be substantially operated under AC current conditions.

4. A low-pressure mercury vapor discharge lamp as claimed in claim 1, wherein the low-pressure mercury vapor discharge lamp further comprising:

a ballast circuit, the ballast circuit including a means for substantially keeping an ignition of the lamp away from the one electrode.

5. A low-pressure mercury vapor discharge lamp as claimed in claim 4, wherein the ballast circuit comprises a circuit assembly comprising a diode.

6. A low-pressure mercury vapor discharge lamp as claimed in claim 1, wherein the low-pressure mercury vapor discharge lamp further comprises a glow starter circuit comprising a circuit assembly comprising a diode.

7. A low-pressure mercury vapor discharge lamp as claimed in claim 1, characterized in that an antenna is provided in the vicinity of the one electrode for guiding away the discharge upon igniting the low-pressure mercury vapor discharge lamp.

8. A low-pressure mercury vapor discharge lamp as claimed in claim 7, characterized in that the antenna comprises a bi-metal.

9. A low-pressure mercury vapor discharge lamp comprising:

a discharge vessel enclosing, in a gastight manner, a discharge space provided with the filling of mercury and an inert gas in a gastight manner, and electrodes arranged in the discharge space for maintaining a discharge in the discharge space, wherein the probability of failure of the low-pressure mercury vapor discharge lamp being substantially determined by one of the electrodes, further wherein the electrodes are provided with an emitter material for supplying electrons to the discharge, the content of barium, calcium and/or strontium in the emitter material of the one electrode being 20% lower than the average barium, calcium or strontium content in the emitter material of the electrodes, respectively.

10. A low-pressure mercury vapor discharge lamp as claimed in claim 1, wherein a temperature of the one electrode is 20% lower than the average temperature of the electrodes under normal operating conditions of the lamp.

11. A low-pressure mercury vapor discharge lamp comprising:

a discharge vessel enclosing, in a gastight manner, a discharge space provided with the filling of mercury and an inert gas in a gastight manner, and electrodes arranged in the discharge space for maintaining a discharge in the discharge space, wherein the probability of failure of the low-pressure mercury vapor discharge lamp being substantially determined by one of the electrodes, further wherein the one electrode is surrounded by an electrode ring, the electrode ring functioning as a cage of Faraday.

* * * * *